US005720058A

United States Patent [19]

Hollander et al.

[11] Patent Number: 5,720,058

[45] Date of Patent: Feb. 24, 1998

[54] COMFORTER

[76] Inventors: Jeffrey M. Hollander, 3985 NW. 53rd St., Boca Raton, Fla. 33496; Leo Hollander, 19647 Oakbrook Cir., Boca Raton, Fla. 33432

[21] Appl. No.: 777,305

[22] Filed: Dec. 27, 1996

[51] Int. Cl.[6] ..... A47G 9/02

[52] U.S. Cl. ..... 5/502; 5/486

[58] Field of Search ..... 5/482, 486, 502

[56] References Cited

U.S. PATENT DOCUMENTS

| | | | |
|---|---|---|---|
| 429,894 | 6/1890 | Doremus | 5/502 |
| 2,348,807 | 5/1944 | Goodstein | 5/502 X |
| 4,748,703 | 6/1988 | Emi et al. . | |
| 5,199,121 | 4/1993 | Payne | 5/486 X |
| 5,299,333 | 4/1994 | Pedersen et al. | 5/502 |
| 5,408,712 | 4/1995 | Brun | 5/502 |

*Primary Examiner*—Michael F. Trettel

*Attorney, Agent, or Firm*—Lerner, David, Littenberg, Krumholz & Mentlik

[57] ABSTRACT

A comforter includes a main body portion and a peripheral region extending along at least one edge of the main body portion. With the comforter placed on a bed, the peripheral region defines an at least partially enclosed space between the upper surface of the bed and the main body portion of the comforter. The main body portion contains a fill material in a first weight per unit area and the peripheral region contains a fill material in a second weight per unit area greater than the first weight per unit area. In use, the greater weight per unit area of the peripheral region substantially reduces air circulation into and out from the at least partially enclosed space, creating insulating qualities that are improved over conventional comforters.

19 Claims, 3 Drawing Sheets

COMFORTER

FIELD OF THE INVENTION

This invention relates to comforters, and more particularly it relates to a comforter having a specific distribution of fill material within its body.

BACKGROUND OF THE INVENTION

Many types of comforters have been used by modern consumers. In view of their light weight, warm natural filling, lofty appearance, and durability, down comforters are particularly popular.

Although down is a superior insulator, and down comforters provide substantial warmth, many consumers remain unsatisfied by the degree of warmth provided by such comforters. This has created a need for enhancing the heat-retaining capability of conventional comforters, including conventional down comforters.

One method for increasing the heat-retaining capability of comforters is simply to increase the amount of fill material within the comforter. However, because the degree of insulation, and thus warmth, provided by a comforter is a function of the amount of air trapped within its outer covering, increasing the amount of fill material is effective only up to a certain point, after which increasing amounts of fill material do not increase the amount of entrapped air, resulting in a heavier but no more insulating comforter. Furthermore, because of the relative cost of down fill materials, increasing the amount of fill material not only results in a comforter which is bulky and uncomfortable to use, but one which is excessively costly to manufacture.

Another approach for increasing the heat-retaining capability of comforters is to use substantially the same amount of fill material as in conventional comforters, but adjust the distribution of the fill material within the comforter's body. For example, U.S. Pat. No. 5,299,333 to Pedersen et al. discloses a comforter having a greater amount of fill material concentrated within its central region, with a substantially reduced amount of fill material in its outside periphery. This distribution of fill material, however, does not always provide sufficient thermal insulation for the person covered by the comforter. The reason for this is that the heat generated by the user's body and accumulated under the bulky central region of the comforter can easily dissipate through the comforter's outside periphery. This dissipation results from the inability of the comforter to keep warm air from escaping and cooler air from entering under the comforter.

Furthermore, since the central region of comforters typically cover a major portion of the user's body, it should be designed not to inhibit, but rather to accommodate the user's movements. Conventional comforters, however, are bulky owing to the substantial amount of fill material contained in their central region, and therefore may hinder the user's movements and be uncomfortable. This may be the case particularly with luxury size comforters having a large amount of fill material.

There therefore is a need for comforters having an improved capability of retaining warmth in the area around the user. Furthermore, there is a need for comforters which provide such warmth without a bulky central region which can inhibit movements of the body.

SUMMARY OF THE INVENTION

The present invention addresses these needs by providing a comforter including a main body portion having a bottom edge, a top edge and a pair of opposed side edges. A pair of opposed panels joined together in the main body portion define at least one cavity which contains a first material such that the main body portion has a first weight per unit area. A peripheral region extending along at least one of the edges of the main body portion includes a pair of opposed panels joined together to define at least one cavity therebetween. The cavity in the peripheral region contains a second material such that the peripheral region has a second weight per unit area greater than the first weight per unit area. Preferably, the second weight per unit area is at least about fifty percent greater than the first weight per unit area.

In preferred embodiments, the peripheral region may extend along the bottom edge and the pair of opposed side edges of the main body portion. Optionally, the peripheral region may also extend along the top edge of the main body portion.

The comforter may also include means separating the at least one cavity in the peripheral region from the at least one cavity in the main body portion for preventing movement of the materials between the peripheral region and the main body portion. The separating means may include a web of material interconnecting the pair of opposed panels along at least one of the edges.

In some embodiments, the first material may be the same as the second material. In preferred embodiments, however, the first and second materials are different. Embodiments in which the first material is down and the second material is a mixture of down and feathers are desirable. In such embodiments, the first weight per unit area preferably is between about 0.003 ounces per square inch and about 0.007 ounces per square inch. Preferred mixtures for the second material may include between about 0 wt % and about 50 wt % down and between about 50 wt % and about 100 wt % feathers.

When the comforter is placed in assembled relationship on a bed, a sealing zone is defined between a peripheral region of the comforter and the bed. The sealing zone defines an at least partially enclosed space between the main body portion of the comforter and the upper surface of the bed, whereby the sealing zone substantially reduces air circulation into and out from the at least partially enclosed space.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

Figure 1:
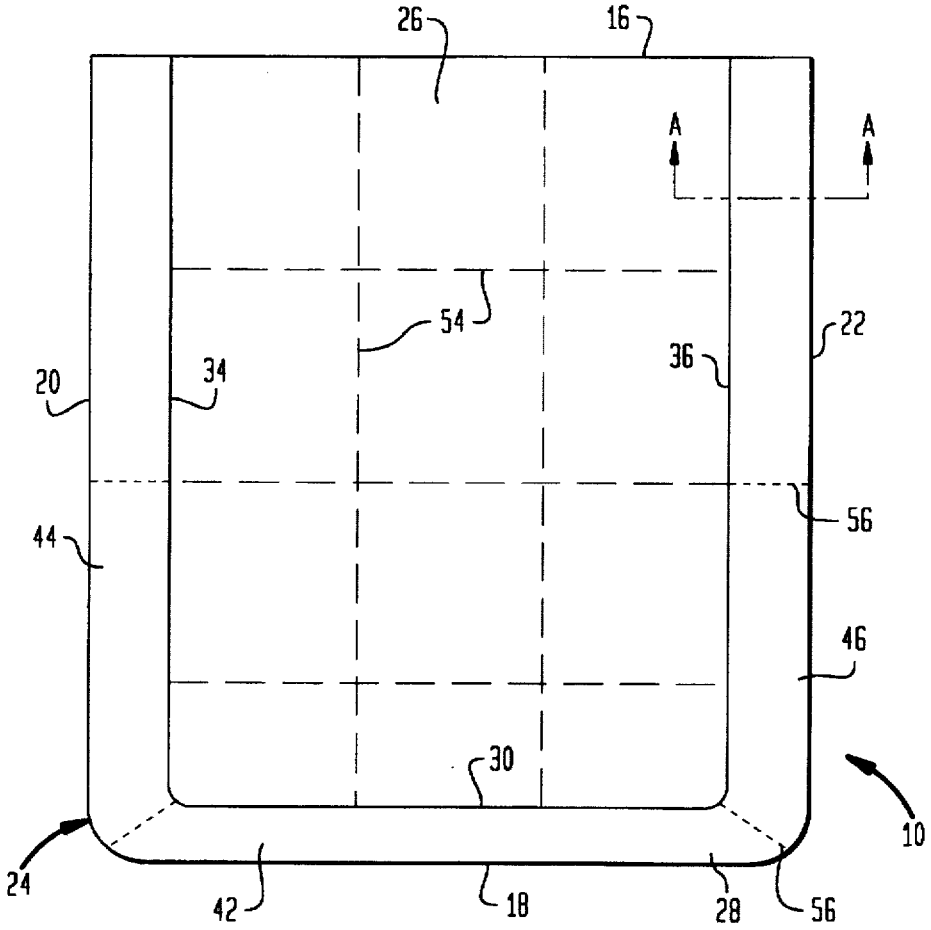
FIG. 1 is a top plan view of a comforter according to one embodiment of the present invention.
Figure 2:
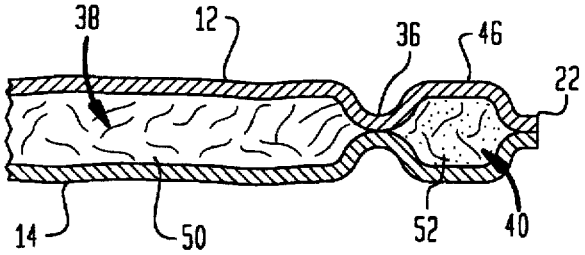
FIG. 2 is a partial cross-sectional view of the comforter of FIG. 1 taken along line A—A.

Referring to FIGS. 1–2, there is illustrated one preferred embodiment of a comforter 10 in accordance with the present invention. Comforter 10 typically has a conventional, generally rectangular plan profile defined by a pair of opposed sheets or panels of material 12 and 14 joined together along top edge 16, bottom edge 18 and side edges 20 and 22 to define a comforter body 24. The material forming panels 12 and 14 preferably is a tightly woven fabric having low air permeability. Examples of such fabric include cotton, silk, nylon and blends of these materials having air permeabilities of 10 cubic feet of air per minute per square foot of fabric as measured using a permeometer.

Comforter body 24 may be divided into a main body portion 26 and a peripheral region 28 by joining panels 12 and 14 together at spaced distances from the edges thereof. Thus, for example, panels 12 and 14 may be joined together, such as by sewing or the like, along bottom joining line 30 and side joining lines 34 and 36 to define a peripheral region 28 having a bottom portion 42 and side portions 44 and 46. Joining lines 30, 34 and 36 may be spaced from the edges of panels 12 and 14 so that bottom portion 42 and side portions 44 and 46 have a width of between about 4 inches and about 14 inches.

Panels 12 and 14 define an interior cavity 38 in main body portion 26 and an interior cavity 40 in peripheral region 28 which is physically separated from interior cavity 38 by joining lines 30, 34 and 36. Cavity 38 contains a fill material 50 and cavity 40 contains a fill material 52, fill materials 50 and 52 together enabling comforter 10 to provide warmth for the user. As discussed further hereinbelow, while fill materials 50 and 52 may be the same, they need not be, so long as cavity 40 contains a greater weight per square inch of fill material than cavity 38.

Optionally, main body portion 26 may include a plurality of stitch lines 54 joining panels 12 and 14 together to divide cavity 38 into a plurality of smaller cavities so as to minimize the degree to which the fill material 50 migrates within main body portion 26. Although stitch lines 54 are shown to be generally straight in the embodiment illustrated in FIG. 1, it will be generally understood that stitch lines 54 may take the form of a repeating S-shaped curve or, for that matter, any pattern which divides cavity 38 into smaller cavities to minimize fill material migration. Stitch lines 54 need not be continuous. That is, stitch lines 54 may be discontinuous to minimize the cold spots resulting from a reduction in trapped air along the stitch lines, while at the same time be sufficient to restrict the migration of the fill material 50 within main body portion 26. Rather than stitch lines 54, main body portion 26 may include a plurality of baffles (not shown) between panels 12 and 14 to divide cavity 38 into multiple smaller cavities and thus minimize fill material migration. Similarly, stitch lines 56 or baffles (not shown) may join panels 12 and 14 together in peripheral region 28 to partition cavity 40 into smaller cavities and thereby prevent fill material 52 from migrating from one portion of the peripheral region to another.

Figure 3:
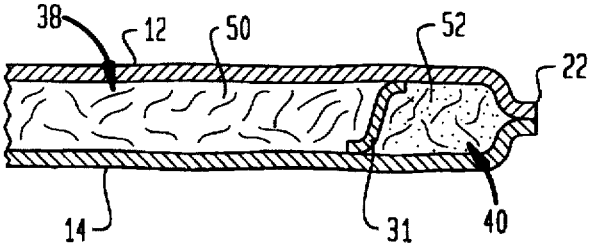
FIG. 3 is a partial cross-sectional view of a comforter according to an alternate embodiment of the present invention.

Rather than joining panels 12 and 14 together along joining lines 30, 34 and 36 to define peripheral region 28, peripheral region 28 may be defined by inserting a baffle 31 between panels 12 and 14 at a spaced distance from the free edges thereof, as illustrated in FIG. 3. The use of a baffle enables cavities 38 and 40 to be filled with the desired amount of fill material all the way up to joining lines 30, 34 and 36, and thus eliminates the potential "cold zone" resulting from the inability to entrap air along the region where panels 12 and 14 are joined directly together, either because of an inability to insert fill material into comforter 10 along that region, or because the fill material inserted therein has become compressed by stitching the panels together. In yet another alternative, peripheral region 28 may be formed as a separate and discrete element by joining together opposed sheets or panels of material to form bottom portion 42 and side portions 44 and 46, and then attached to main body portion 26, such as by sewing or the like.

Fill materials 50 and 52 may consist of any materials commonly used to stuff pillows, comforters and other stuffed objects. Such materials may include, for example, feathers, down, polymer fibers including polyester fibers, foam materials including foam rubber and urethane foams, and combinations of the foregoing. In use, main body portion 26 of comforter 10 covers all or at least a major portion of a person's body. Accordingly, fill material 50 is preferably selected so that main body potion 26 forms a layer which has good insulating qualities, but which is light in weight so as to not interfere with the movements of the user below the comforter. In that regard, down is a particularly preferred fill material for filling cavity 38 because of its light weight and superior insulating properties. As used herein, the word "down" refers to commercial grades of down which typically include a minimum of about 70 wt % down cluster, about 10 wt % down fiber and about 20 wt % feathers and miscellaneous residue. Preferably, cavity 38 is filled with a sufficient amount of down to contain the heat generated by a person covered by comforter 10. In that regard, between about 0.003 ounces per square inch and about 0.007 ounces per square inch of down fill is preferred. The combination of the down fill and the tightly woven fabric of panels 12 and 14 produces a structure in main body portion 26 which is light in weight and which has low air permeability and good insulating qualities. During the use of comforter 10, this structure efficiently retains the warm air surrounding the user in the space between the main body portion 26 of comforter 10 and the top surface of the bed.

The amount of fill material 50 used to fill cavity 38 will depend upon the fill material selected. Thus, where cavity 38 is filled with feathers, between about 0.004 ounces per square inch and about 0.009 ounces per square inch of such material is preferred, and where polyester fibers are used as fill material 50, between about 0.004 ounces per square inch and about 0.006 ounces per square inch of such fiber is preferred for filling cavity 38.

Peripheral region 28, on the other hand, does not overlie and directly insulate the user during the use of comforter 10, but rather contacts the surface of the bed to define a sealing zone circumscribing the user. This sealing zone enables peripheral region 28 to minimize the flow of warm air out from the space below main body portion 26 and the flow of cold air into such space, thereby reducing the dissipation of heat from around the user. In order to create this sealing zone, peripheral region 28 is designed to have a greater weight per unit area than main body portion 26. Desirably, peripheral region 28 has a weight per unit area which is at least about 40% greater than the weight per unit area in main body portion 26. More preferably, the weight per unit area of peripheral region 28 is about 1.5 to about 4 times the weight per unit area of main body portion 26, it being understood that the greater the weight of the fill material in peripheral region 28, and the wider the peripheral region itself, the more effective the sealing zone will be.

One way of making the weight of peripheral region 28 relatively greater than that of main body portion 26 is to fill peripheral region 28 with a greater weight per unit area of fill material than that in main body portion 26. This may be done by filling cavity 40 with the same down used to fill cavity 38, but at a greater weight per square inch. However, since peripheral region 28 does not overlie the user, the insulating quality of the fill material 52 therein need not be as good as the insulating quality of fill material 50. Hence, rather than using the down used to fill cavity 38 in main body portion 26, cavity 40 may be filled with 100 wt % feathers or a mixture of down and feathers which is somewhat less insulating than down alone. The down and feathers may be combined in any ratio desired, with mixtures from about 0 wt % down/100 wt % feathers to about 50 wt % down/50 wt % feathers being preferred, and mixtures from about 10 wt % down/90 wt % feathers to about 50 wt % down/50 wt % feathers being particularly preferred. The total weight of fill material 52 in cavity 40 preferably is between about 0.0047 ounces per square inch and about 0.027 ounces per square inch when main body portion 26 is filled with down. It will be appreciated that proportionately greater amounts of fill materials 50 and 52 will be used for stuffing both main body portion 26 and peripheral region 28 in larger size comforters, and that proportionately lesser amounts of these fill materials will be used in smaller comforters, although the weights of fill material per unit area will preferably be the same for all comforters.

Since comforter 10 in accordance with the present invention provides a greater degree of heat retention than conventional comforters without the need for greater amounts of fill material, the comforter 10 of the present invention typically will be as easy to handle and fluff as conventional comforters.

It has been indicated hereinabove that the weight per unit area of fill material 52 in peripheral region 28 of comforter 10 is substantially greater than the weight per unit area of fill material 50 in main body portion 26 thereof. In such arrangement, the overall weight of comforter 10 may be greater than the weight of a conventional comforter of the same overall size. However, since the main body portion 26 covering the user is filled with about the same or less fill material per unit area as is used in a conventional comforter, comforter 10 will have a feel to the user which is substantially similar to or lighter than that of a conventional comforter.

Moreover, because peripheral region 28 may be filled with a less costly mixture of down and feathers, comforter 10 of the present invention may be less costly to produce than conventional comforters. This is particularly the case as the width of peripheral region 28 is increased. Since peripheral region 28 seals in the warm air surrounding the user under main body portion 26, one aspect of this cost savings may be realized by filling main body portion 26 with a lower weight per unit area of fill material than is used throughout conventional comforters, thus resulting in a substantial reduction in the amount of relatively costly fill materials used. This reduction occurs without sacrificing any of the functions or aesthetic qualities of the comforter.

A second aspect of this cost savings results from the fact that the more costly fill materials are used in an "undiluted state" only in the main body portion 26 of comforter 10, not in the entire comforter. Thus, depending upon the width of peripheral region 28 and the percentage of these costly fill materials used therein, this may result in a substantial overall reduction in use of the more costly fill materials. For example, in a queen size comforter having typical dimensions of 86 inches×86 inches, a peripheral region 28 which is 4 inches wide will yield a main body portion which is about 86% of the total area of the comforter, reducing by about 14% the amount of the more costly fill material used where the peripheral region contains 100 wt % of the less costly fill material, and reducing by about 7% the amount of the more costly fill material used where the peripheral region contains a mixture of 50 wt % of the less costly fill material and 50 wt % of the more costly fill material. Where peripheral region 28 is 14 inches wide, the main body portion 26 will constitute only about 56% of the total area of the comforter, yielding even greater reductions in the amount of the more costly fill material used.

Figure 4:
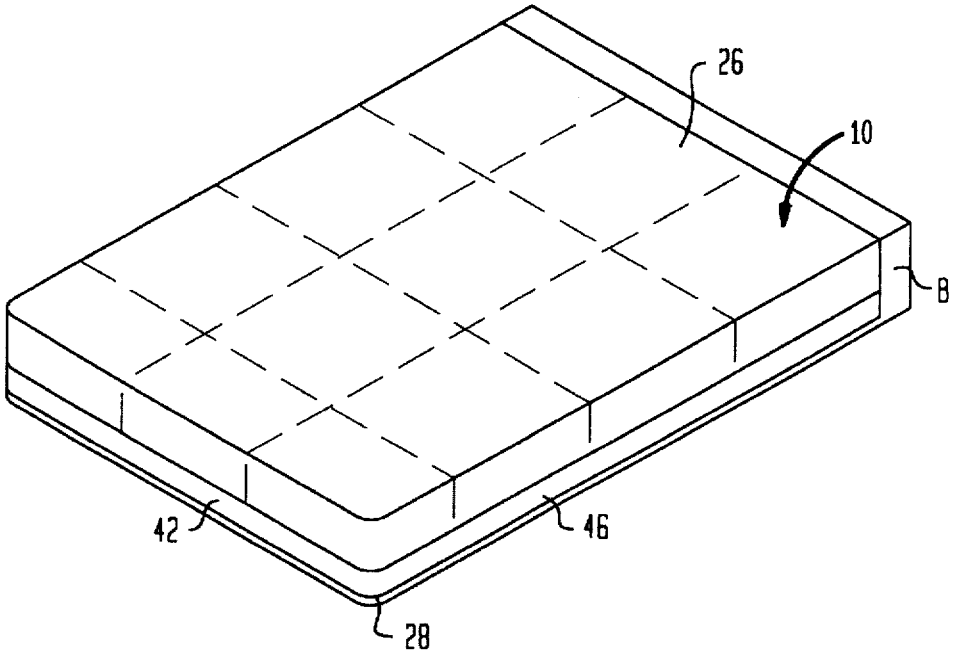
FIG. 4 is a highly schematic perspective view illustrating application of the comforter of FIG. 1 to a relatively narrow and short bed.

The improved warmth-retaining capability of comforter 10 will now be described with reference to FIGS. 4 and 5. Where comforter 10 is larger in length and width than the bed B on which it is used, as illustrated in FIG. 4, main body portion 26 may be as wide as, and possibly even wider than, the width of the bed, and longer than the length of the bed, such that side portions 44 and 46 and bottom portion 42 of peripheral region 28 hang downwardly against the sides of the bed. When the comforter is used to cover the body of a user in these instances, a trapped area is formed between the comforter and substantially the entire upper surface of the bed. The weight of the peripheral region 28 will hold the comforter close to the bed, creating a sealing zone along the periphery of the bed at its top surface.

Figure 5:
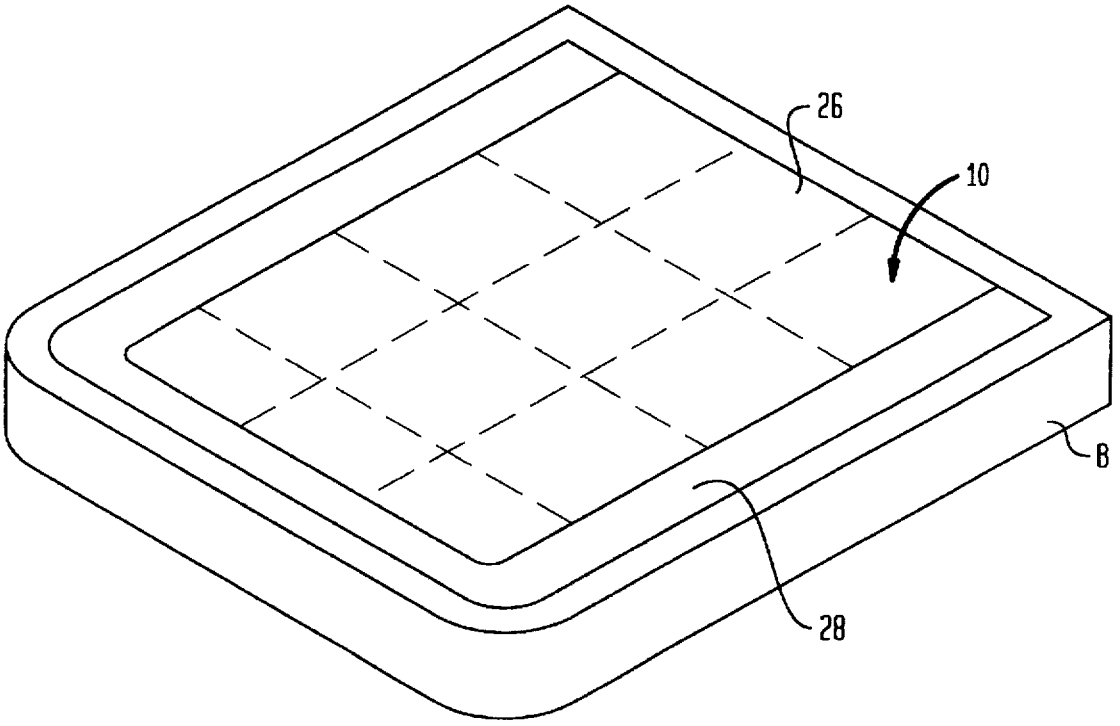
FIG. 5 is a highly schematic perspective view illustrating application of the comforter of FIG. 1 to a relatively wide and long bed.

Alternatively, as illustrated in FIG. 5, comforter 10 may be used with a relatively wide and long bed B, such that the width and length of the bed are equal to or greater than the full width and length of the comforter. When such comforter is properly positioned on the bed, the main body portion 26 and at least a portion of the peripheral region 28 may be superimposed over the top surface of the bed. When the comforter is used to cover the body of a user in this scenario, a trapped area is formed between main body portion 26 and the portion of the upper surface of the bed underlying main body portion 26. Furthermore, the peripheral region 28 will also lie upon the top surface of the bed, its relative weight holding the peripheral region firmly against the bed and creating a sealing zone circumscribing the trapped area.

Figure 6:
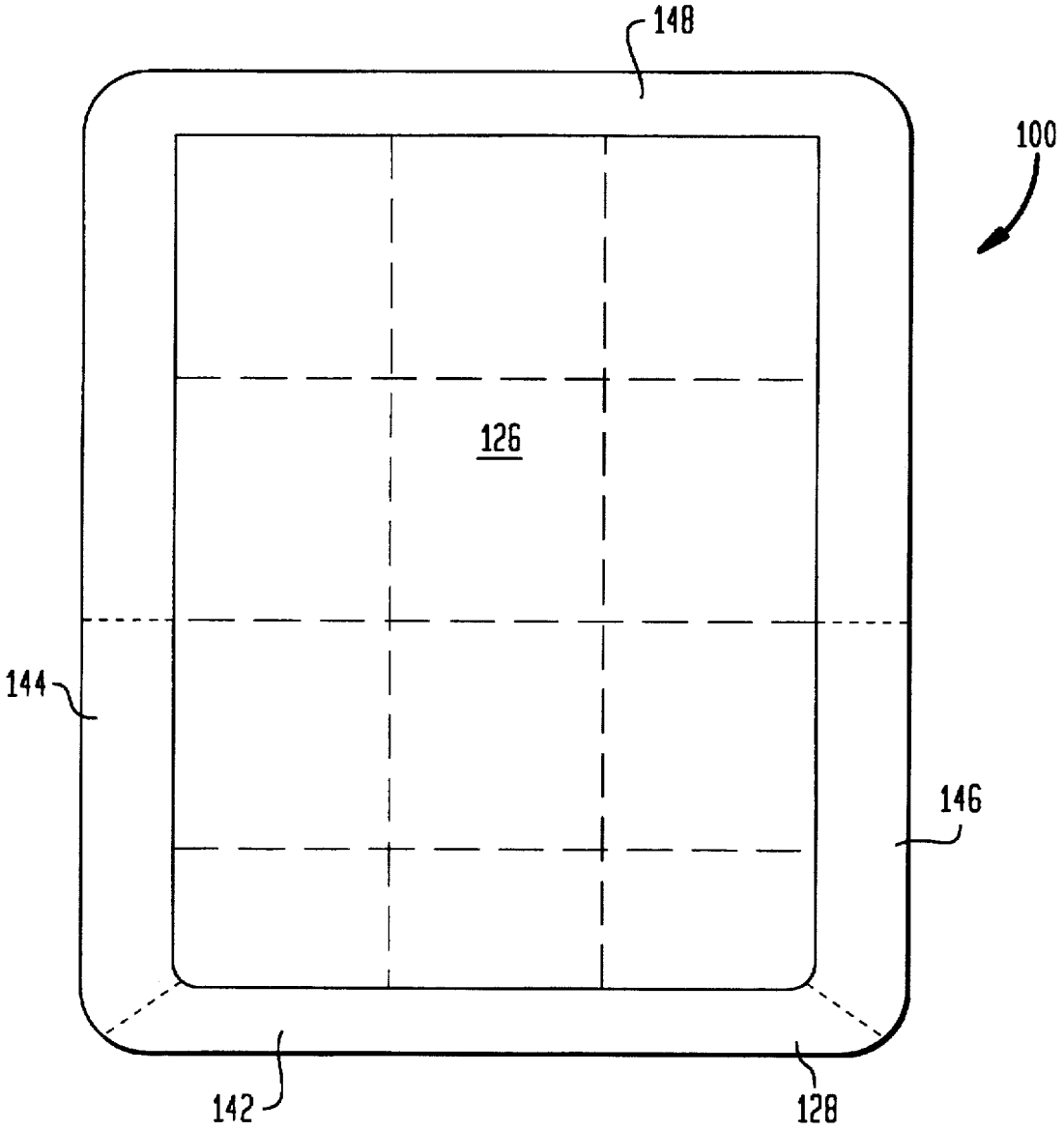
FIG. 6 is a top plan view of a comforter according to a further embodiment of the present invention.

An alternate embodiment of a comforter 100 in accordance with the present invention is shown in FIG. 6. Comforter 100 differs from comforter 10 in that peripheral region 128 thereof includes a top portion 148 in addition to bottom portion 142 and side portions 144 and 146 so that peripheral region 128 entirely surrounds main body portion 126. Although this embodiment may evidence an improved heat-retaining capability over comforter 10 by extending the sealing zone around the entire trapped area, the top portion 148 of peripheral region 128 would lie across the upper torso or neck of the user, and the heavier weight of fill material in this portion may be uncomfortable. On the other hand, the comforter would be reversible in that either end of the comforter could be positioned at the head of the bed.

Rather than using a greater weight per unit area of fill material in the peripheral region of the comforter than that used to fill the main body portion thereof, the present invention contemplates other arrangements for producing a comforter in which the peripheral region has a greater overall weight per unit area than the main body portion. One such arrangement would be to add weights to the peripheral region 28 of the comforter within interior cavity 40. Such weights may include, for example, heavy cordings, pliable metals or heavily stuffed feather cords. Alternatively, cavity 40 in peripheral region 28 may incorporate spot weights, such as those used in draperies or shower curtains, at spaced intervals along the perimeter of the comforter. Where such weights are added to the periphery of the comforter, peripheral region 28 may be filled with the same weight per unit area of fill material as is used to fill main body portion 26. Indeed, in such embodiments the comforter need not have a main body portion and peripheral region which are distinct from one another, but rather may include a pair of opposed panels joined together to define a single cavity extending the entire length and width of the comforter. This single cavity may, of course, be divided by stitch lines or baffles into smaller cavities to minimize the migration of the fill material therein.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as set forth in the appended claims.

I claim:

1. A comforter, comprising a main body portion having a bottom edge, a top edge, a pair of opposed side edges, and a pair of opposed panels joined together to define at least one cavity therebetween;

a first material contained within said at least one cavity in said main body portion, said first material being down;

a peripheral region extending along at least one of said edges and including a pair of opposed panels joined together to define at least one cavity therebetween; and a second material contained within said at least one cavity in said peripheral region, said second material being a mixture of down and feathers;

said main body potion having a first weight per unit area and said peripheral region having a second weight per unit area greater than said first weight per unit area.

2. The comforter as claimed in claim 1, wherein said second weight per unit area is at least about 40% greater than said first weight per unit area.

3. The comforter as claimed in claim 1, wherein said peripheral region extends along said bottom edge and said pair of opposed side edges of said main body portion.

4. The comforter as claimed in claim 3, wherein said peripheral region extends along said top edge of said main body portion.

5. The comforter as claimed in claim 1, wherein said first weight per unit area is between about 0.003 ounces per square inch and about 0.007 ounces per square inch.

6. The comforter as claimed in claim 1, further comprising means separating said at least one cavity in said peripheral region from said at least one cavity in said main body portion for preventing movement of said materials between said peripheral region and said main body portion.

7. The comforter as claimed in claim 6, wherein said separating means comprises a web of material interconnecting said pair of opposed panels along said at least one of said edges.

8. The comforter as claimed in claim 1, wherein said pair of opposed panels in said main body portion are formed from a tightly woven fabric having low air permeability.

9. The comforter as claimed in claim 1, wherein said mixture includes between about 0 wt % and about 50 wt % down and between about 50 wt % and about 100 wt % feathers.

10. A comforter in assembled relationship on a bed, comprising a bed having an upper surface;

a comforter positioned on said bed, said comforter including a main body potion having a bottom edge, a top edge, a pair of opposed side edges, and a pair of opposed panels joined together to define at least one cavity therebetween, a first material contained within said at least one cavity in said main body portion, said first material being down, a peripheral region extending along at least one of said edges and including a pair of opposed panels joined together to define at least one cavity therebetween, and a second material contained within said at least one cavity in said peripheral region, said second material being a mixture of down and feathers, said main body potion having a first weight per unit area and said peripheral region having a second weight per unit area greater than said first weight per unit area; and a sealing zone defined between said peripheral region and said bed and defining an at least partially enclosed space between said main body potion and said upper surface of said bed, whereby said sealing zone substantially reduces air circulation into and out from said at least partially enclosed space.

11. The assembly as claimed in claim 10, wherein said second weight per unit area is at least about 40% greater than said first weight per unit area.

12. The assembly as claimed in claim 10, wherein said peripheral region extends along said bottom edge and said pair of opposed side edges of said main body portion.

13. The assembly as claimed in claim 12, wherein said peripheral region extends along said top edge of said main body portion.

14. The comforter as claimed in claim 10, wherein said first weight per unit area is between about 0.003 ounces per square inch and about 0.007 ounces per square inch.

15. The assembly as claimed in claim 10, further comprising means separating said at least one cavity in said peripheral region from said at least one cavity in said main body portion for preventing movement of said materials between said peripheral region and said main body portion.

16. The assembly as claimed in claim 10, wherein said mixture includes between about 0 wt % and about 50 wt % down and between about 50 wt % and about 100 wt % feathers.

17. A comforter, comprising a main body portion having a bottom edge, a top edge, a pair of opposed side edges, and a pair of opposed panels joined together to define at least one cavity therebetween;

a first material contained within said at least one cavity in said main body portion;

a peripheral region extending along at least one of said edges and including a pair of opposed panels joined together to define at least one cavity therebetween;

a second material contained within said at least one cavity in said peripheral region, said second material being substantially the same as said first material; and a barrier permanently separating said at least one cavity in said peripheral region from said at least one cavity in said main body portion for preventing movement of said materials between said peripheral region and said main body portion;

said main body portion having a fixed first weight per unit area and said peripheral region having a fixed second weight per unit area greater than said first weight per unit area.

18. The comforter as claimed in claim 17, wherein said first and second materials are down.

19. The comforter as claimed in claim 17, wherein said first and second materials are a mixture of down and feathers.

* * * * *